US012331535B1

(12) United States Patent
O'Donnell

(10) Patent No.: US 12,331,535 B1
(45) Date of Patent: Jun. 17, 2025

(54) ROOF-MOUNTED SAFETY FOOTHOLD

(71) Applicant: Kevin O'Donnell, Broomall, PA (US)

(72) Inventor: Kevin O'Donnell, Broomall, PA (US)

( * ) Notice: Subject to any disclaimer, the term of this patent is extended or adjusted under 35 U.S.C. 154(b) by 793 days.

(21) Appl. No.: 17/673,994

(22) Filed: Feb. 17, 2022

(51) Int. Cl.
*E04G 21/32* (2006.01)
*E04G 3/26* (2006.01)
*E04D 12/00* (2006.01)

(52) U.S. Cl.
CPC ..... *E04G 21/3214* (2013.01); *E04G 3/26* (2013.01); *E04D 12/004* (2013.01)

(58) Field of Classification Search
CPC ..... E04G 21/3214; E04G 21/32; E04G 3/26; E04D 3/10; E04D 3/12; E04D 12/004; E04D 2001/3414; E04D 2001/3417; E04C 3/04; E04C 2003/046; E04C 2003/0434
USPC ..... 182/45; 52/24, 102, 204.2, 551, 630, 52/182, 846, 851, 855, 749.12
See application file for complete search history.

(56) References Cited

U.S. PATENT DOCUMENTS 3,466,071 A * 9/1969 Reed ..... E04B 1/2608 403/231
3,694,990 A * 10/1972 Pamer ..... E04C 3/06 29/463
3,737,131 A * 6/1973 Larson ..... A47F 5/0823 211/70.6
3,824,664 A * 7/1974 Seeff ..... B21D 13/10 72/379.6
4,067,168 A * 1/1978 Thurner ..... E04B 5/29 403/279
4,106,247 A * 8/1978 Svensson ..... E04C 3/02 52/204.2
4,280,308 A * 7/1981 Svensson ..... E04B 1/7046 52/98
4,332,308 A * 6/1982 Larson ..... E06C 7/16 182/120
4,450,935 A 5/1984 Gustavus
D296,186 S * 6/1988 Korn ..... D8/346
4,793,113 A * 12/1988 Bodnar ..... E04B 2/58 52/634
4,863,307 A * 9/1989 Jones ..... E01C 11/221 404/8
4,989,689 A * 2/1991 Berlin ..... E04G 21/24 256/60
5,240,343 A * 8/1993 Strobl, Jr. ..... E01C 11/221 404/8
5,287,944 A * 2/1994 Woodyard ..... E04D 13/12 248/237

(Continued)

FOREIGN PATENT DOCUMENTS

WO 2015020817 2/2015

*Primary Examiner* — Robert Canfield
(74) *Attorney, Agent, or Firm* — Kyle A. Fletcher, Esq.

(57) ABSTRACT

The roof-mounted safety foothold is a safety device. The roof-mounted safety foothold is configured for use on a pitched roof. The roof-mounted safety foothold forms a guard that prevents objects and individuals from sliding off of the pitched roof. The roof-mounted safety foothold incorporates a plurality of guard members, a gusset structure, and an interior cant. The plurality of guard members combine to form an offset lateral disk. The gusset structure is a bracing structure used to stabilize the offset lateral structure formed by the plurality of guard members. The interior cant is a cant formed by the plurality of guard members.

11 Claims, 5 Drawing Sheets

(56) References Cited

U.S. PATENT DOCUMENTS 5,913,780 A * 6/1999 Goergen ..... A01M 29/32 156/295
H1795 H * 7/1999 Leek ..... E04B 1/2604 52/712
6,071,038 A * 6/2000 Strobl, Jr. ..... E01C 11/221 47/33
6,167,987 B1 1/2001 Jensen
6,220,390 B1 4/2001 Pike
6,243,995 B1 * 6/2001 Reeves ..... E04D 13/004 52/96
6,393,796 B1 * 5/2002 Goettl ..... E04D 12/004 52/302.1
6,415,559 B1 * 7/2002 Reeves ..... E04D 13/158 52/95
D516,228 S * 2/2006 Dunbar ..... D25/113
7,195,421 B2 * 3/2007 Dunbar ..... E01C 11/221 47/33
7,658,356 B1 * 2/2010 Nehls ..... F24S 25/613 248/237
7,774,993 B2 * 8/2010 Strobl, Jr. ..... E01C 11/221 47/33
D639,587 S * 6/2011 Selinger ..... D6/712
D644,503 S * 9/2011 Crane ..... D8/382
8,151,535 B1 * 4/2012 Thompson ..... E04B 1/2608 52/715
D663,020 S * 7/2012 Purnell ..... D23/386
8,312,678 B1 * 11/2012 Haddock ..... E04D 12/004 52/101
D730,545 S * 5/2015 Stauffer ..... D25/61
D732,708 S * 6/2015 Stauffer ..... D25/61
9,109,371 B2 8/2015 Hudson
9,468,962 B2 * 10/2016 Houston ..... B21D 47/01
D785,205 S 4/2017 Ramphos
10,174,496 B2 * 1/2019 Bertato ..... E04F 15/02183
10,729,077 B2 * 8/2020 Bahler ..... A01G 9/28
D993,763 S * 8/2023 Glogovsky ..... D8/354
2002/0046543 A1 4/2002 Neuleib
2005/0210825 A1 * 9/2005 Peleg ..... E04D 12/004 52/748.1
2005/0218277 A1 * 10/2005 Shaw ..... E04G 17/14 248/201
2005/0284045 A1 * 12/2005 Smith ..... E04C 3/02 52/204.2
2006/0207195 A1 * 9/2006 Donoho ..... A01M 29/32 52/101
2007/0034449 A1 2/2007 Leendertse
2009/0223121 A1 * 9/2009 Jones ..... A01G 9/28 47/33
2010/0229492 A1 * 9/2010 Harkin ..... E04G 23/0237 52/645

* cited by examiner

ROOF-MOUNTED SAFETY FOOTHOLD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of safety and protective measures for persons during the construction of buildings. (E04G21/32)

SUMMARY OF INVENTION

The roof-mounted safety foothold is a safety device. The roof-mounted safety foothold is configured for use on a pitched roof. The roof-mounted safety foothold forms a guard that prevents objects and individuals from sliding off of the pitched roof. The roof-mounted safety foothold incorporates a plurality of guard members, a gusset structure, and an interior cant. The plurality of guard members combine to form an offset lateral structure. The gusset structure is a bracing structure used to stabilize the offset lateral structure formed by the plurality of guard members. The interior cant is a cant formed by the plurality of guard members.

These together with additional objects, features and advantages of the roof-mounted safety foothold will be readily apparent to those of ordinary skill in the art upon reading the following detailed description of the presently preferred, but nonetheless illustrative, embodiments when taken in conjunction with the accompanying drawings.

In this respect, before explaining the current embodiments of the roof-mounted safety foothold in detail, it is to be understood that the roof-mounted safety foothold is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the roof-mounted safety foothold.

It is therefore important that the claims be regarded as including such equivalent construction insofar as they do not depart from the spirit and scope of the roof-mounted safety foothold. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
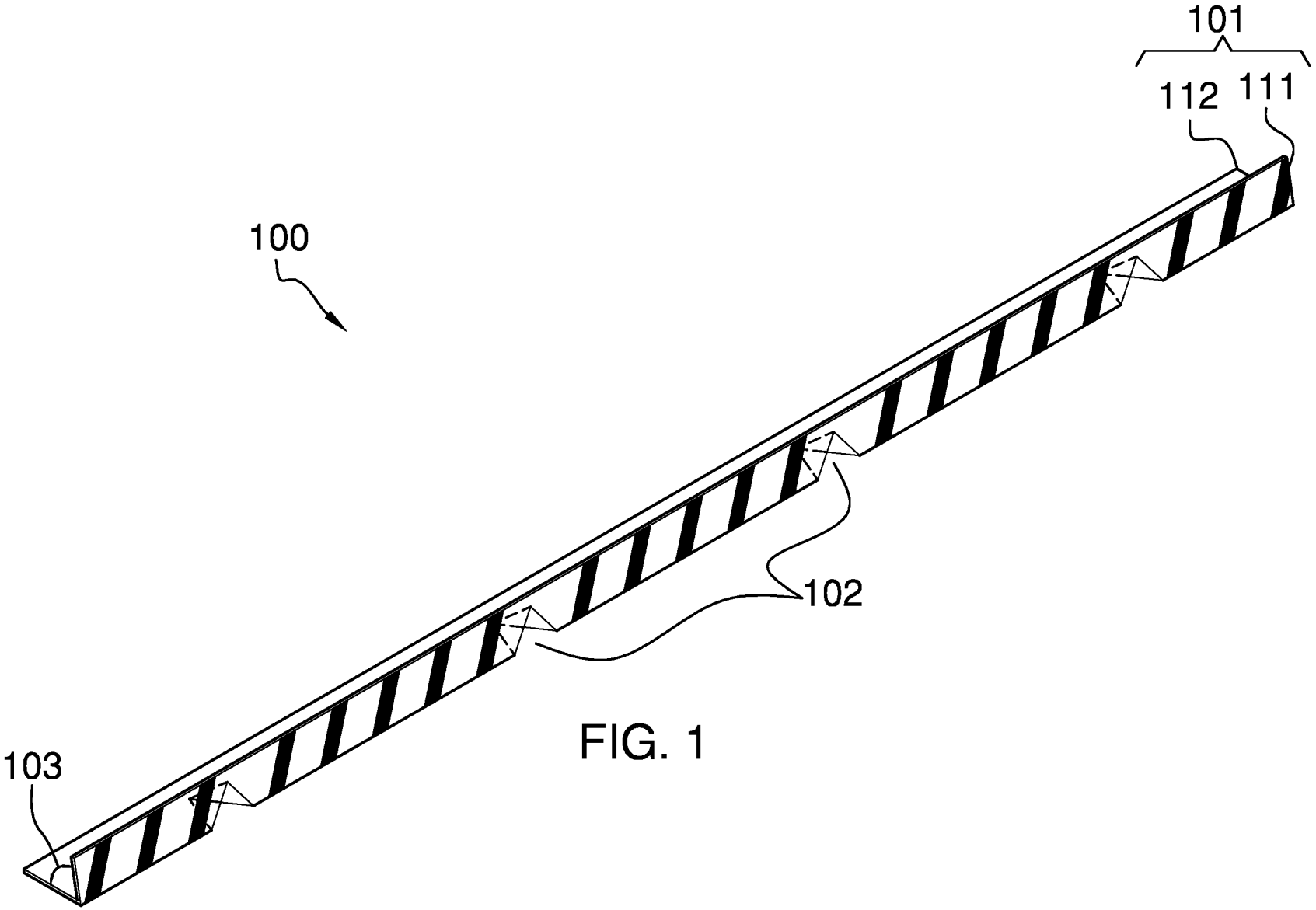
FIG. 1 is a perspective view of an embodiment of the disclosure.
Figure 2:
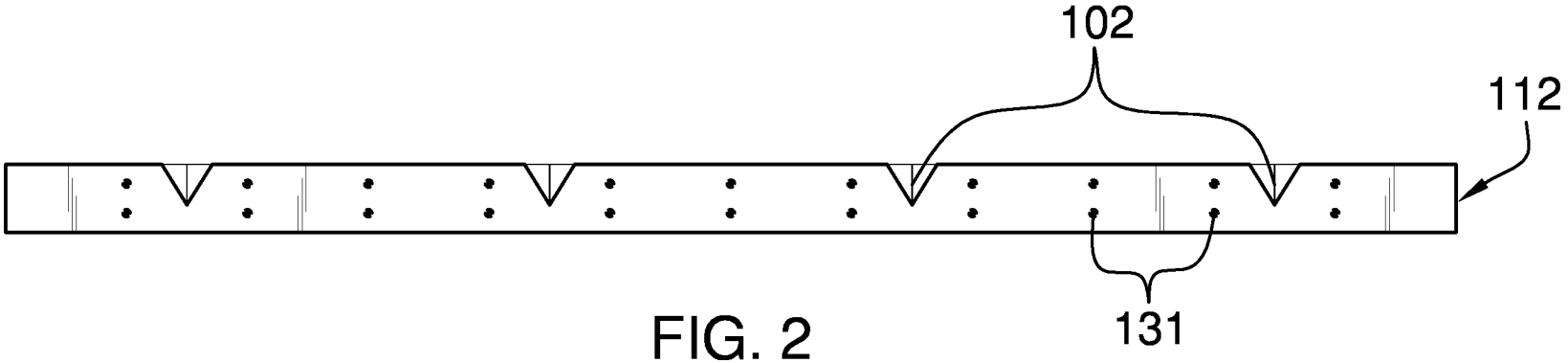
FIG. 2 is a bottom view of an embodiment of the disclosure.
Figure 3:
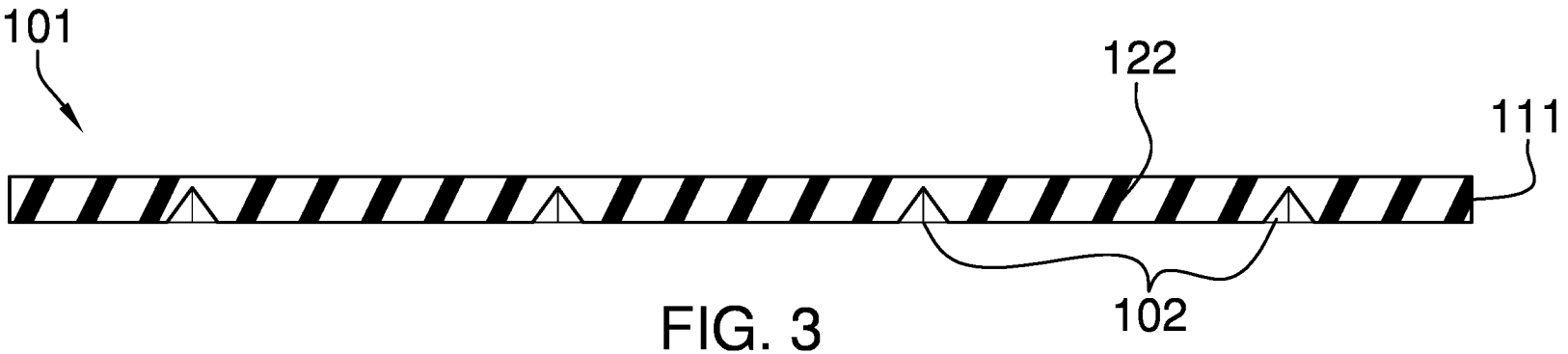
FIG. 3 is a front view of an embodiment of the disclosure.
Figure 4:
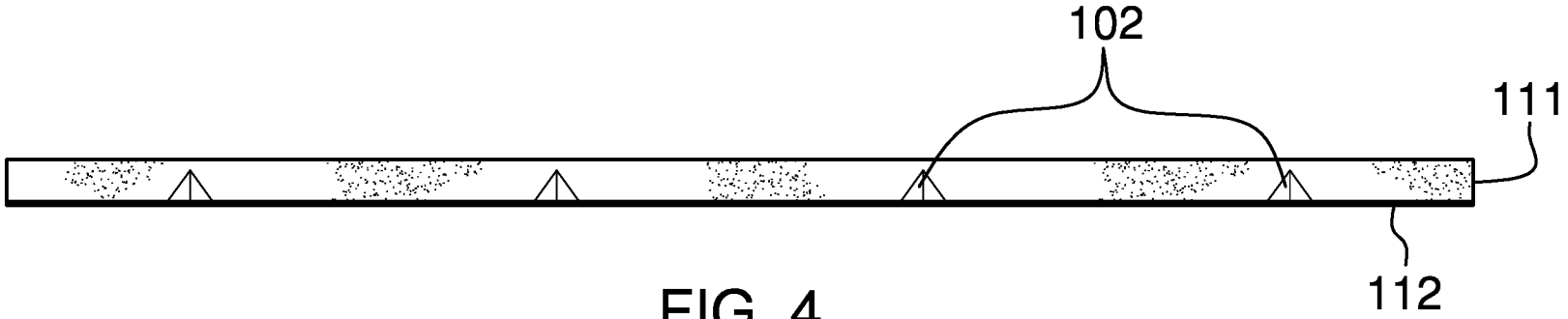
FIG. 4 is a rear view of an embodiment of the disclosure.
Figure 5:
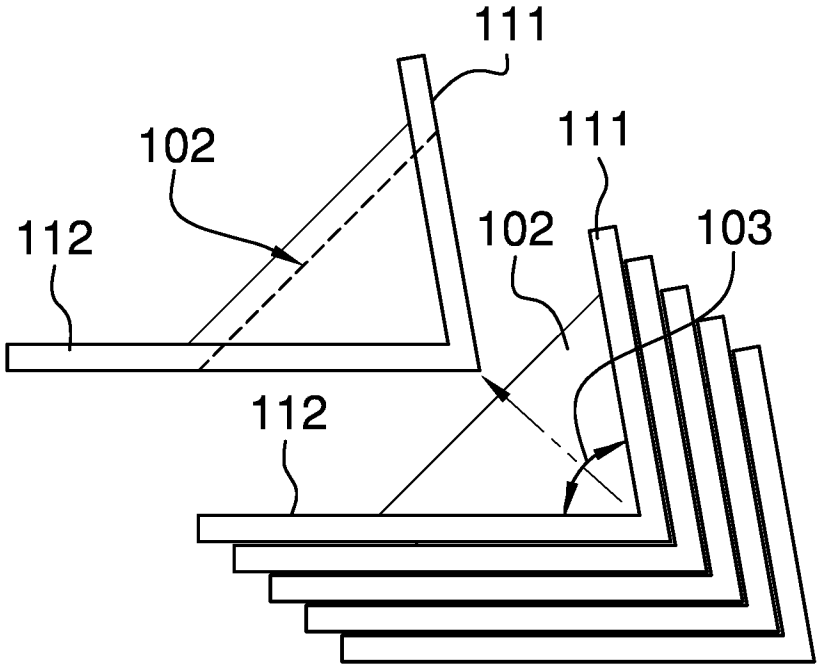
FIG. 5 is a side view of an embodiment of the disclosure.
Figure 6:
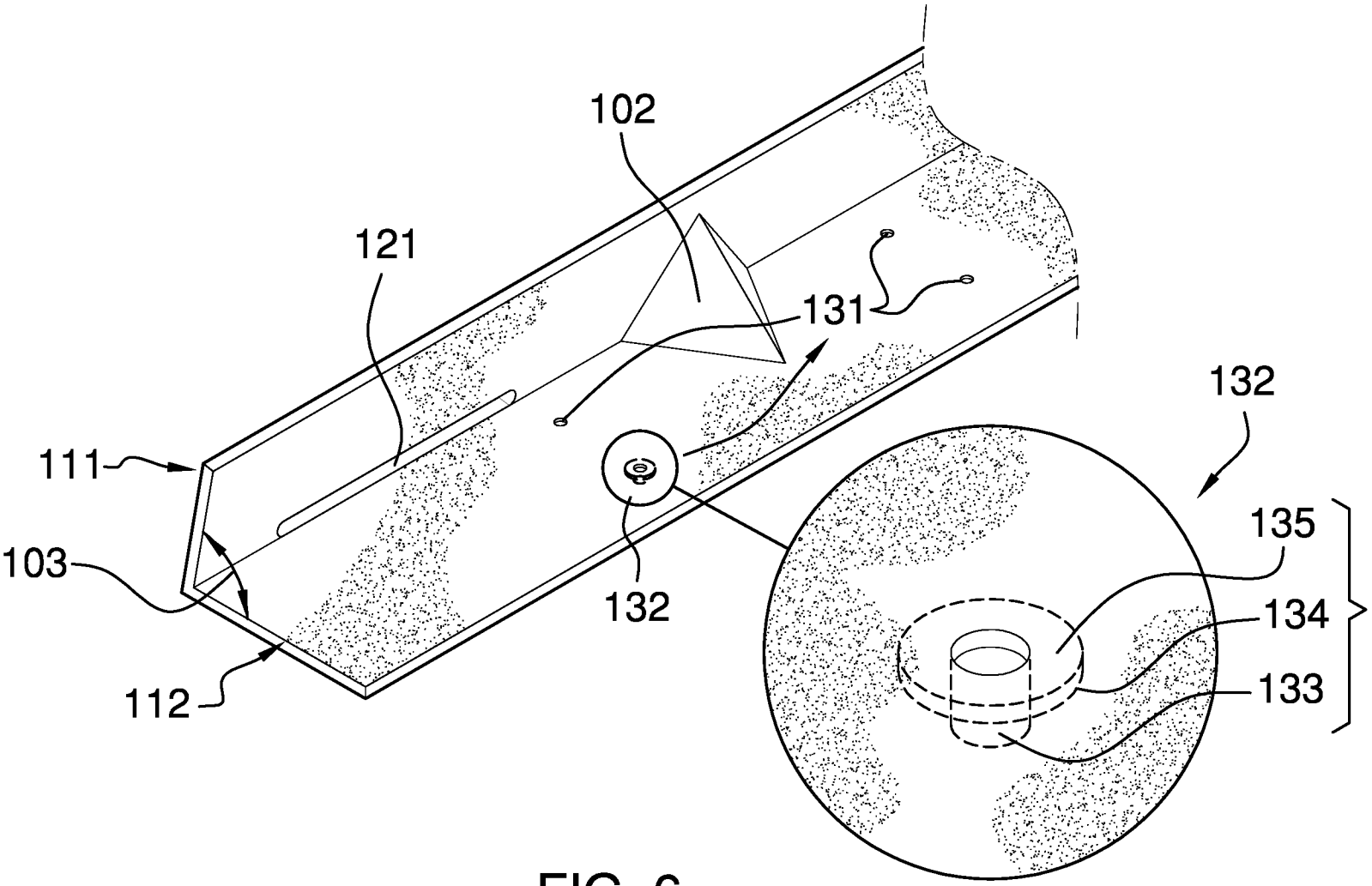
FIG. 6 is a reverse perspective view of an embodiment of the disclosure.

Detailed reference will now be made to one or more potential embodiments of the disclosure, which are illustrated in FIGS. 1 through 6.

The roof-mounted safety foothold 100 (hereinafter invention) is a safety device. The invention 100 is configured for use on a pitched roof. The invention 100 forms a guard that prevents objects and individuals from sliding off of the pitched roof. The invention 100 comprises a plurality of guard members 101, a gusset structure 102, and an interior cant 103. The plurality of guard members 101 combine to form an offset lateral structure. The gusset structure 102 is a bracing structure used to stabilize the offset lateral structure formed by the plurality of guard members 101. The interior cant 103 is a cant formed by the plurality of guard members 101.

The plurality of guard members 101 is a rigid structure. The plurality of guard members 101 has an offset lateral shape. The plurality of guard members 101 attaches to the superior surface of the pitched roof. The plurality of guard members 101 forms a pedestal structure that bears the load of an object that is sliding off of the pitched roof. The plurality of guard members 101 transfers the sliding load to the pitched roof such that the object will not slide off of the pitched roof. The offset lateral disk formed by the plurality of guard members is further defined with a concave surface and a convex surface. The terms concave and convex are defined elsewhere in this disclosure. The plurality of guard members 101 comprises a first guard member 111 and a second guard member 112.

The first guard member 111 is a rigid structure. The first guard member 111 has rectangular congruent ends. The first guard member 111 further comprises a plurality of shingle slots and a non-skid surface 122.

Each shingle slot selected from the plurality of shingle slots 121 is a slot that is formed through the congruent ends of the first guard member 111 of the plurality of guard members 101. Each shingle slot selected from the plurality of shingle slots 121 is sized such that a shingle can be inserted through any shingle slot selected from the plurality of shingle slots 121. The use of the plurality of shingle slots 121 allows a shingle to be positioned on the roof without running the risk of the shingle being bent and broken by the superior lateral face of the first guard member 111.

The non-skid surface 122 is a non-skid structure that is formed on the congruent end of the first guard member 111 that forms the convex surface of the invention 100. The non-skid surface 122 is formed from a non-skid material. The non-skid surface 122 prevents objects for sliding past the invention 100 and potentially off of the pitched roof.

The form factor of the first disk 111 is identical to the form factor of the second disk 112. The lateral face of the second guard member permanently attaches to the lateral face of the first guard member 111 to form the rigid offset lateral structure formed by the plurality of guard members 101. Specifically, the lateral face of the second guard member 112 with the greatest span of length attaches to the lateral face of the first disk 111 with the greatest span of length to form the offset lateral disk structure formed by the plurality of guard members 101. The second guard member 112 attaches to the superior surface of the pitched roof. The convex surface of the second guard member 112 sits flush against the superior surface of the pitched roof when the second guard member 112.

The second guard member 112 is a rigid structure. The second guard member 112 has rectangular congruent ends. The second guard member 112 further comprises a plurality of mounting nuts 131.

The plurality of mounting nuts 131 comprises a collection of individual mounting nuts 132. Each individual mounting nut 132 selected from the plurality of mounting nuts is a nut that is formed on the congruent end of the disk structure of the second guard member 112. Each individual mounting nut 132 selected from the plurality of mounting nuts 131 provides a channel that allows for the use of a fastening device, such as a nail, to secure the second guard member 112 to the pitched roof. Any individual mounting nut 132 initially selected from the plurality of mounting nuts 131 is identical to any subsequently selected individual mounting nut 132 selected from the plurality of mounting nuts 131.

Each individual mounting nut 132 comprises a mounting aperture 133, a recess 134, and a spacer 135.

Each mounting aperture 133 is formed through the congruent ends of the second guard member 112. The mounting aperture 133 forms the negative space that is characteristic of a nut.

The recess 134 is a negative space that is formed in the concave surface of the second guard member 112. The recess 134 forms a negative space. The center axis of the recess 134 aligns with the center axis of the mounting aperture 133. The recess 134 is sized such that the spacer 135 inserts into the recess 134.

The spacer 135 is a ring shaped structure. The spacer 135 is selected such that the spacer 135 will fit into the recess 134 such that the mounting aperture 133, the recess 134 and the spacer 135 form a composite prism structure. The spacer 135 removably installs in the recess 134. The spacer 135 is a replaceable structure. The characteristic aperture of the ring structure of the spacer 135 guides the fastening device through the mounting aperture 133. The individual mounting nut 132 adjusts to differences in the diameter of the fastening device by changing the size of the characteristic aperture of the ring structure of the spacer 135 that inserts into the recess 134.

The aperture, nut, recess 134, and the spacer 135 are defined elsewhere in this disclosure. The interior cant 103 is the cant that is formed by the plurality of guard members 101. The interior cant 103 is the cant that is formed between the concave surface of the first guard member 111 and the concave surface of the second guard member 112.

The gusset structure 102 is a pyramid structure. The gusset structure 102 is a hollow structure. The gusset structure 102 is formed as a pyramidal segment. The gusset structure 102 forms a brace that secures the first guard member 111 of the plurality of guard members 101 to the second guard member 112 of the plurality of guard members 101. The gusset structure 102 mounts on the concave surfaces of the first guard member 111 and the second guard member 112. The bifurcating surface that forms the pyramidal segment of the gusset structure 102 forms a negative space that provides access into the hollow interior of the gusset structure 102. The bifurcating surface that forms the pyramidal segment of the gusset structure 102 aligns with the first guard member 111 such that an aperture is formed through the first guard member 111 that provides access into the hollow interior of the gusset structure 102.

The pyramidal segment structure of the gusset structure 102 allows a second instantiation of invention 100 to stack on the concave surfaces of a first instantiation of the invention 100 by inserting the gusset structure 102 of the first instantiation into the gusset structure 102 of the second instantiation through the aperture formed by the bifurcating surface that forms the pyramidal segment of the gusset structure 102 of the second instantiation.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Aperture: As used in this disclosure, an aperture is a prism-shaped negative space that is formed completely through a structure or the surface of a hollow structure.

Brace: As used in this disclosure, a brace is a rigid structural element that interconnects a first object with a second object to form a resulting object. The brace forms an energy transfer structure that distributes and shares the forces applied to the resulting object between the first object and the second object. The brace is used to support, stabilize, or otherwise steady an object.

Brink: As used in this disclosure, a brink refers to the edge or line formed by the intersection of a first plane or surface and a second plane or surface wherein a cant exists between the first plane or surface and the second plane or surface.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Gusset: As used in this disclosure, a gusset is an angled structural member used to stabilize a section of a framework. By angled is meant that the gusset is neither parallel nor perpendicular to the structures being stabilized.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Lateral Disk Structure: As used in this disclosure, a lateral disk structure refers to the juxtaposition of a first lateral face of a first disk-shaped structure to a second lateral face of a second disk-shaped structure such that: a) the center axes of the first disk and the second disk are parallel; and, b) the congruent ends of the first disk are parallel to the congruent ends of the second disk. The span of the length of the center axes of the first disk and the second disk need not be equal. The form factor of the congruent ends of the first disk and the second disk need not be geometrically similar.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Metal: As used in this disclosure, a metal is an element that readily loses electrons or an alloy formed from a plurality of such elements. General properties of metals include, but are not limited to, the ability to conduct heat, conduct electricity, malleability, and the ability to be drawn into a wire. For the purposes of this disclosure, the term metal is assumed to include the transition metals (columns 3-12 of the periodic table) and aluminum, tin, and lead. The alkali metals (columns 1 of the periodic table) and the alkali earth metals (column 2 of the periodic table) are assumed to be excluded from this definition. In this disclosure, the preferred metals for conducting electricity are selected from the group consisting of copper, aluminum, silver, and gold. In this disclosure, the preferred metals for structural purposes are selected from the group consisting of aluminum, iron, and iron based mixtures of metals commonly referred to as steel.

N-gon: As used in this disclosure, an N-gon is a regular polygon with N sides wherein N is a positive integer number greater than 2.

Negative Space: As used in this disclosure, negative space is a method of defining an object through the use of open or empty space as the definition of the object itself, or, through the use of open or empty space to describe the boundaries of an object.

Non-Skid Material: As used in this disclosure, a non-skid material is a material or structure that can be applied to an object such that the object is inhibited from sliding along the surface upon which the object is resting. Non-skid materials are often, but not always, adhesive, elastic, or abrasive materials.

Nut (No thread): As used in this disclosure, a nut is a prism or disk-shaped negative space that is formed through a surface. The nut is sized to receive a shaft that is inserted through the congruent ends of the prism or disk-shaped negative space.

Offset Lateral Disk Structure: As used in this disclosure, an offset lateral disk structure refers to the juxtaposition of a first lateral face of a first disk structure to a second lateral face of a second disk structure in the manner of a lateral disk structure except that one or more of the following conditions need not be true: a) the center axes of the first prism and the second prism are no longer parallel; and, b) the congruent ends of the first prism are no longer parallel to the congruent ends of the second prism.

Offset Lateral Prism Structure: As used in this disclosure, an offset lateral prism structure refers to the juxtaposition of a first lateral face of a first prism structure to a second lateral face of a second prism structure in the manner of a lateral prism structure except that one or more of the following conditions need not be true: a) the center axes of the first prism and the second prism are no longer parallel; and, b) the congruent ends of the first prism are no longer parallel to the congruent ends of the second prism.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Pitched Roof: As used in this disclosure; a pitched roof refers to a roof wherein the surface of the roof forms a cant that is not perpendicular to the force of gravity.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pyramid: As used in this disclosure, a pyramid is a three-dimensional shape that comprises a base formed in the shape of an N-gon (wherein N is an integer) with N triangular faces that rise from the base to converge at a point above the base. The center axis of a pyramid is the line drawn from the vertex where the N faces meet to the center of the N-gon base. The center axis of a right pyramid is perpendicular to the N-gon base. Pyramids can be further formed with circular or elliptical bases which are commonly referred to as a cone or an elliptical pyramid respectively. A pyramid is defined with a base, an apex, and a lateral face. The base is the N-gon shaped base described above. The apex is the vertex that defines the center axis. The lateral face is formed from the N triangular faces described above.

Pyramidal Segment: As used in this disclosure, a pyramidal segment refers to a pyramid that is bifurcated by a single plane that is parallel to or contains the center axis of the prism or cylinder.

Ridge: As used in this disclosure, a ridge is an elevated or raised portion of a structure.

Rigid Structure: As used in this disclosure, a rigid structure is a solid structure formed from an inelastic material that resists changes in shape. A rigid structure will permanently deform as it fails under a force. See bimodal flexible structure.

Ring: As used in this disclosure, a ring is term that is used to describe a disk-like structure through which a negative space is formed through the faces of the disk-like structure. Rings are often considered loops.

Roof: As used in this disclosure, a roof refers to the superior surface of a hollow structure. The roof typically encloses the hollow structure.

Semi-Enclosed Prism: As used in this disclosure, a semi-enclosed prism is a prism-shaped structure wherein a portion of the lateral face of the prism-shaped is removed or otherwise replaced with a negative space. Always use negative space.

Shingle: As used in this disclosure, a shingle is a disk-shaped tile that is used to form the superior surface of a roof. Shingles are overlapped such that water is routed along the pitch without leaking beneath the layer of shingles.

Slide: As used in this disclosure, slide is a verb that refers to an object that is transported along a surface while in continuous contact with the surface. An object being transported along a surface with wheels cannot be said to be sliding. A slide over a short distance is referred to as a slip.

Slot: As used in this disclosure, a slot is a prism-shaped negative space formed as a groove or aperture that is formed in or through an object.

Spacer: As used in this disclosure, a spacer is a prism-shaped disk that is formed with a cylindrical negative space that allows a shaft to be inserted through the faces of the disk structure of the spacer. A spacer is further defined with an inner dimension. A spacer is often referred to as a washer.

Stack: As used in this disclosure, a stack refers to a collection of disk-shaped objects that are stored such that the congruent ends of each of the disk-shaped objects are placed against each other such that the congruent ends are parallel to each other. The term stack often implies that the congruent ends of the disk-shaped objects are horizontally oriented.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A roof-mounted safety foothold comprising a plurality of guard members, a gusset structure, and an interior cant;

wherein the plurality of guard members combine to form an offset lateral structure;

wherein the gusset structure is a bracing structure used to stabilize the offset lateral disk structure formed by the plurality of guard members;

wherein the interior cant is a cant formed by the plurality of guard members;

wherein the plurality of guard members comprises a first guard member having an end congruent with an end of a second guard member;

wherein the second guard member attaches to the first guard member;

wherein the first guard member further comprises a plurality of shingle slots and a non-skid surface;

wherein each shingle slot selected from the plurality of shingle slots is a slot that is formed through the congruent end of the first guard member of the plurality of guard members;

wherein the non-skid surface is a non-skid structure that is formed on an exterior of the first guard member of the roof-mounted safety foothold.

2. The roof-mounted safety foothold according to claim 1 wherein the roof-mounted safety foothold is a safety device;

wherein the roof-mounted safety foothold is configured for use on a pitched roof;

wherein the roof-mounted safety foothold forms a guard.

3. The roof-mounted safety foothold according to claim 2 wherein the plurality of guard members form a rigid structure;

wherein the plurality of guard members attaches to the superior surface of the pitched roof;

wherein the plurality of guard members forma pedestal structure.

4. The roof-mounted safety foothold according to claim 3 wherein the first guard member disk is a rigid structure;

wherein the first guard member has rectangular congruent ends.

5. The roof-mounted safety foothold according to claim 4 wherein the second guard member attaches to the superior surface of the pitched roof;

wherein the second guard member is a rigid structure;

wherein the second guard member has rectangular congruent ends.

6. The roof-mounted safety foothold according to claim 5 wherein the form factor of the first guard member is identical to the form factor of the second guard member;

wherein the outer surface of the second guard member sits flush against the superior surface of the pitched roof.

7. The roof-mounted safety foothold according to claim 6 wherein the gusset structure is a pyramid structure;

wherein the gusset structure is a hollow structure;

wherein the gusset structure is formed as a pyramidal segment;

wherein the gusset structure forms a brace that secures the first guard member of the plurality of guard members to the second guard member of the plurality of guard members;

wherein the gusset structure mounts on the interior surfaces of the first guard member and the second guard member.

8. The roof-mounted safety foothold according to claim 7 wherein each shingle slot selected from the plurality of shingle slots is sized such that a shingle can be inserted through any shingle slot selected from the plurality of shingle slots.

9. The roof-mounted safety foothold according to claim 8 wherein the non-skid surface prevents objects for sliding past the roof-mounted safety foothold.

10. The roof-mounted safety foothold according to claim 9 wherein the second guard member further comprises a plurality of mounting nuts;

wherein each individual mounting nut selected from the plurality of mounting nuts is a nut that is formed on the congruent end of the second guard member;

wherein each individual mounting nut selected from the plurality of mounting nuts provides a channel that allows for the use of a fastening device, such as a nail, to secure the second guard member to the pitched roof;

wherein any individual mounting nut initially selected from the plurality of mounting nuts is identical to any subsequently selected individual mounting nut selected from the plurality of mounting nuts.

11. The roof-mounted safety foothold according to claim 10 wherein each individual mounting nut comprises a mounting aperture, a recess, and a spacer;

wherein each mounting aperture is the disk shaped negative space formed through the congruent ends of the second guard member;

wherein the mounting aperture forms the negative space that is characteristic of a nut;

wherein the recess is a negative space that is formed in the concave surface of the second guard member;

wherein the recess forms a disk shape negative space;

wherein the center axis of the recess aligns with the center axis of the mounting aperture;

wherein the recess is sized such that the spacer inserts into the recess;

wherein the spacer is a ring shaped structure;

wherein the spacer is selected such that the spacer will fit into the recess such that the mounting aperture, the recess and the spacer form a composite structure;

wherein the spacer removably installs in the recess;

wherein the spacer is a replaceable structure;

wherein the characteristic aperture of the ring structure of the spacer guides the fastening device through the mounting aperture;

wherein the individual mounting nut adjusts to differences in the diameter of the fastening device by changing the size of the characteristic aperture of the ring structure of the spacer that inserts into the recess.

* * * * *